US010358950B2

(12) United States Patent
Buhl et al.

(10) Patent No.: US 10,358,950 B2
(45) Date of Patent: Jul. 23, 2019

(54) PIN OF A VALVE CONTROL LEVER

(71) Applicants: Harald Buhl, Deisslingen (DE); Manfred Mattes, Kolbingen (DE); Peter Scharnberger, Tuttlingen (DE); Verena Weigand, Tuttlingen (DE)

(72) Inventors: Harald Buhl, Deisslingen (DE); Manfred Mattes, Kolbingen (DE); Peter Scharnberger, Tuttlingen (DE); Verena Weigand, Tuttlingen (DE)

(73) Assignee: Aktiebolaget SKF, Göte borg (SE)

( * ) Notice: Subject to any disclaimer, the term of this patent is extended or adjusted under 35 U.S.C. 154(b) by 149 days.

(21) Appl. No.: 15/276,908

(22) Filed: Sep. 27, 2016

(65) Prior Publication Data

US 2017/0089225 A1 Mar. 30, 2017

(30) Foreign Application Priority Data

Sep. 28, 2015 (DE) ..... 10 2015 218 632

(51) Int. Cl.

| | |
|---|---|
| ***F01L 1/18*** | (2006.01) |
| ***F01L 1/24*** | (2006.01) |
| ***F01M 9/10*** | (2006.01) |

(52) U.S. Cl.

CPC ..... *F01L 1/182* (2013.01); *F01L 1/185* (2013.01); *F01L 1/2405* (2013.01); *F01M 9/10* (2013.01); *F01L 2103/00* (2013.01); *F01L 2105/00* (2013.01); *F01L 2810/02* (2013.01)

(58) Field of Classification Search

CPC ... F01L 1/182; F01L 2810/02; F01L 2103/00; F01L 1/185; F01L 1/2405; F01L 2105/00; F01M 9/10

See application file for complete search history.

(56) References Cited

U.S. PATENT DOCUMENTS

| | | | | |
|---|---|---|---|---|
| 4,541,373 A * | 9/1985 | Ishida | F01L 1/2405 | 123/90.46 |
| 5,823,154 A * | 10/1998 | Kuhn | F01L 1/181 | 123/90.33 |
| 6,619,252 B2 * | 9/2003 | Haas | F01L 1/146 | 123/90.48 |
| 2007/0224349 A1 * | 9/2007 | Hosenfeldt | C23C 14/024 | 427/249.1 |

FOREIGN PATENT DOCUMENTS

| | | | |
|---|---|---|---|
| DE | 4324835 | A1 | 1/1995 |
| DE | 19549221 | A1 | 7/1997 |
| DE | 19803278 | A1 | 8/1999 |
| DE | 102013211049 | A1 | 3/2014 |
| JP | H07259959 | A | 10/1995 |
| JP | 2009257567 | A | 11/2009 |

* cited by examiner

*Primary Examiner* — Mark A Laurenzi
*Assistant Examiner* — Wesley G Harris
(74) *Attorney, Agent, or Firm* — Bryan Peckjian; SKF USA Inc. Patent Dept.

(57) ABSTRACT

A cylindrical pin of a valve control lever has an outer side wall, a first end wall and a second end wall and includes a blind bore that extends from a blind bore opening in the first end wall to an inner surface of the second end wall, the inner surface forming a blind bore base, the blind bore base including at least one through opening.

10 Claims, 2 Drawing Sheets

PIN OF A VALVE CONTROL LEVER

CROSS-REFERENCE

This application claims priority to German patent application no. 10 2015 218 632.6 filed on Sep. 28, 2015, the contents of which are fully incorporated herein by reference.

TECHNOLOGICAL FIELD

The present disclosure is directed to a cylindrical pin of a valve control lever, in particular a rocker arm or rocker lever, as well as a method for manufacturing the cylindrical pin and a coating system therefor.

BACKGROUND

The cams of a camshaft are used for valve control in internal combustion engines. Here the movement of the cam is transmitted to the valve using a valve control lever, for example a rocker lever or rocker arm. In general the valve control lever includes a base body that is rotatably supported about an axis and that includes a receptacle for connecting to a camshaft connecting element, which receptacle is rotatably attached via pins to the valve control lever.

Such a pin is generally cylindrical and includes a lubricant distribution device in order to provide lubrication between the pin and the camshaft connection element and/or the valve control lever. For this purpose the pins can include lubricant channels fluidly connected to one another, which distribute lubricant to elements rotatably supported with respect to one another. Furthermore it has proved to be advantageous if not only a lubricant channel but also a lubricant reservoir is formed in the pin in order to provide a valve control that is as maintenance-free as possible. This lubricant reservoir is usually provided via a blind bore formed in the pin.

However, it is disadvantageous with this conventional approach that the blind bore must be reworked in a very expensive manner in order to remove drilling burrs formed during the bore drilling process, in particular at the bottom or base of the blind bore. When lubricant flows around the burrs, metal particles may be dislodged that are then carried via the lubricant to the to-be-lubricated points. This may increase wear and can lead to a total failure of the valve control.

A further problem with the conventional pins is the difficulty involved in applying a coating to the pins. The known pins must be individually introduced into a coating chamber in an upright position, i.e., standing on one of their end walls, in order to harden their outer wall. Here it must be absolutely prevented that the pins contact one another at their outer walls and maintain a sufficient distance to one another so that a uniform coating can be applied to the pins. This method is very complex and cost-intensive.

SUMMARY

An aspect of the present disclosure is therefore to provide a pin of a valve control lever that overcomes the above-mentioned disadvantages of the prior art.

In the following description, a cylindrical pin of a valve control lever is presented including an outer wall defining a first and a second end wall and including a blind bore that extends from a first end wall up to a second opposing end wall, wherein at the first end wall a blind bore opening is formed and at the second end wall a blind bore base is formed. As used herein, the term "blind bore" is not limited to the sense of a bore or opening that is completely closed on one end. Instead, "blind-bore" refers to any bore having an open first end and a second end that is completely or partially closed. The closed end may therefore be completely closed, as in the case of a conventional blind bore, or the closed end may have an opening, smaller than the bore diameter, formed therein.

The disclosure is based on the idea that the base or bottom of the blind bore includes at least one through opening that offers the advantage that the pin is attachable via the blind bore opening and via the through opening, for example, mountable on a bar that extends all the way through the pin, so that at least two disclosed pins can be strung together and/or stacked one-over-the-other in order to subject them to a hardening- and/or edge-layer- and/or another coating-method. Here the pins can contact at their edge walls so that it is possible in particular to simultaneously coat the outer wall of the pins in a simple manner. Alternatively or additionally the pins can also be coated while strung together in a contactless manner, for example, spaced by spacer elements. The at least two pins can of course be strung together via other elements known from the prior art, instead of via a bar, which other elements make it possible to stack and/or string together the pins, and prevent the pins from falling over during the hardening- and/or coating method. Due to the disclosed through opening the manufacturing of the pins can be simplified and the manufacturing costs of the pins can be reduced since a plurality of pins can be processed simultaneously. Furthermore, drilling burrs that may be formed when the blind hole is formed can be easily removed with the help of the passage bore. Foreign particles, e.g., parts of the metal burrs or debris trapped by the metal burrs, can thereby be reliably prevented being caught up in a lubricant flow and reaching the to-be-lubricated points, so that the proper functioning and thus the service life of the valve control is not impaired. In addition, with the help of the through opening, contaminants can be more effectively loosened, for example in a washing process, before the pin is put into service.

In one preferred exemplary embodiment the through opening is smaller than the blind-hole opening. Preferably only a small closure element for sealing and closing the through opening is thereby needed so that material and costs associated therewith can be saved.

According to a further preferred exemplary embodiment at least one closure element is received, preferably by press-fit, in the through opening. Here a dimensioning of the through opening is preferably configured smaller than a dimensioning of the closure element so that the through opening is closable in a simple manner by press-fit. Furthermore, the closure element is preferably spherical or ellipsoidal so that a favorable flow behavior of the fluid can also simultaneously be provided. Here according to a further preferred exemplary embodiment the closure element is formed from a relatively soft material, for example, copper. Furthermore it is preferred that the material of the closure element is softer than the material of the cylindrical pin in order to press it in into the through opening in a simple manner. Due to the press-fit, further parts, for example for securing, can be omitted. Of course instead of the press fit other known connection types, detachable or permanent, from the prior art can be used.

According to a further preferred exemplary embodiment the outer wall includes at least two through bores that are configured to bring a fluid, in particular a lubricant, into and out of the pin. Here either or both of the through bores can be drilled openings.

The open end of the blind bore is also preferably closable using a closure element. Thus the pin can be impinged by a fluid, in particular by an oil, in order to supply an environment of the pin with a lubricant.

In a further preferred exemplary embodiment, the outer wall of the pin is hardened or coated. The pin thereby receives a particularly high wear resistance and can withstand high mechanical stresses.

Another embodiment of the disclosure comprises a cylindrical pin of a valve control lever that has an outer side wall, a first end wall, and a second end wall. A bore having a first diameter extends into the cylindrical pin from the first end wall and has a bore bottom between the first end wall and the second end wall. There is a through opening in the bore bottom, the through opening having a second diameter less than the first diameter.

A further aspect of the disclosure relates to a method for manufacturing a cylindrical pin having one of the above-mentioned features, wherein the method comprises the following steps: a) drilling a blind bore in the cylindrical pin, which blind bore extends from a first end wall up to a second opposing end wall, wherein at the first end wall a blind bore opening is formed and at the second end wall a blind bore base is formed; b) introducing at least one through opening in the blind bore base, preferably by drilling; c) introducing a first and a second opening in an outer wall of the cylindrical pin, preferably by drilling; d) stacking together or stringing together the cylindrical pins, wherein the at least two pins are each stacked via the blind bore opening and the through opening, preferably on a bar; and e) coating and/or hardening and/or edge-layer hardening of the at least two stacked-together and/or strung-together cylindrical pins. The at least two pins preferably contact each other at their end walls during stacking-together or stringing-together. Of course the pins can be strung together in any manner and they can also be coated strung together in a contactless manner.

A further aspect of the disclosure comprises a coating system for coating at least two cylindrical pins with a coating device. Here the coating system includes a stacking device for stacking together and/or stringing together at least two cylindrical pins that can preferably contact at their end walls, and are respectively stacked one-atop-the-other using the stacking device via their blind bore opening and via their through opening. Alternatively or additionally the pins can also be coated while they are strung together in a contactless manner, for example, while they are spaced by spacers. Here the at least two cylindrical pins have one of the above-mentioned features. The stacking device can be, for example, a rod or bar onto which the at least two cylindrical pins can each be stacked one-atop-the-other via their blind bore openings and via their through openings so that they do not fall over during a hardening method and/or coating method. Of course any elements known from the prior art for stacking and/or stringing together the pins can be used so long as they make possible a stacking and/or a stringing together via the blind bore opening and the through opening of a pin. Additionally or alternatively, instead of a coating system it can be a hardening system. That is, instead of coating the pins while they are strung together, the pins could alternately be subjected to a hardening process while strung together as described above.

In the following description, the disclosure will be explained in more detail with reference to exemplary embodiments depicted in the drawings. Here the exemplary embodiments are of a purely exemplary nature and are not intended to establish the scope of the application. This scope is defined solely by the patent claims. It is explicitly noted that all features that are depicted in combination can of course also be interpreted as individual features or combined in other ways.

DETAILED DESCRIPTION

In the following, identical or functionally equivalent elements are designated by the same reference numbers.

Figure 1:
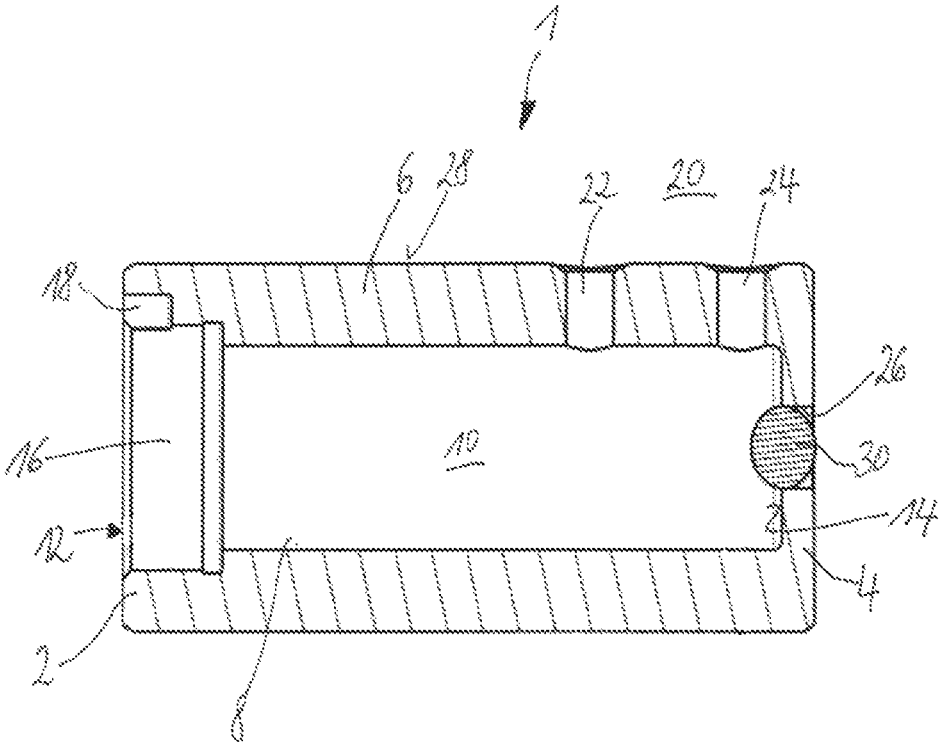
FIG. 1 is a schematic depiction of a longitudinal section through an inventive cylindrical pin.

FIG. 1 schematically shows a longitudinal section through a cylindrical pin 1 of a valve control lever (not shown) including a first end wall 2 and a second end wall 4 that are defined by an outer wall 6. The pin 1 furthermore includes a blind bore 8 that extends from the first end wall 2 up to the second opposing end wall 4, whereby a hollow interior 10 of the pin 1 is formed. Here a blind bore opening 12 is formed on the first end wall 2 and a blind bore base 14 is formed on the second end wall 4. In order to impinge the pin 1 with a fluid, in particular a lubricating oil, the blind bore opening 12 includes a closure 16 which may comprise, for example, a plastic stopper. Furthermore a securing element 18 for securing the closure element 16 in the blind bore opening 12 is also provided. In general it would be possible to close the blind bore opening 12 with other closure elements, for example, a ball-type element fittable in press-fit.

In order to make possible a lubricating between the pin 1 and its environment 20, for example, a camshaft connecting element and/or a valve control lever, the outer wall 6 of the pin 1 includes a first through opening 22 and a second through opening 24 via which a fluid, for example, a lubricant, can be brought into and out of the interior 10 of the pin 1.

Figure 2:
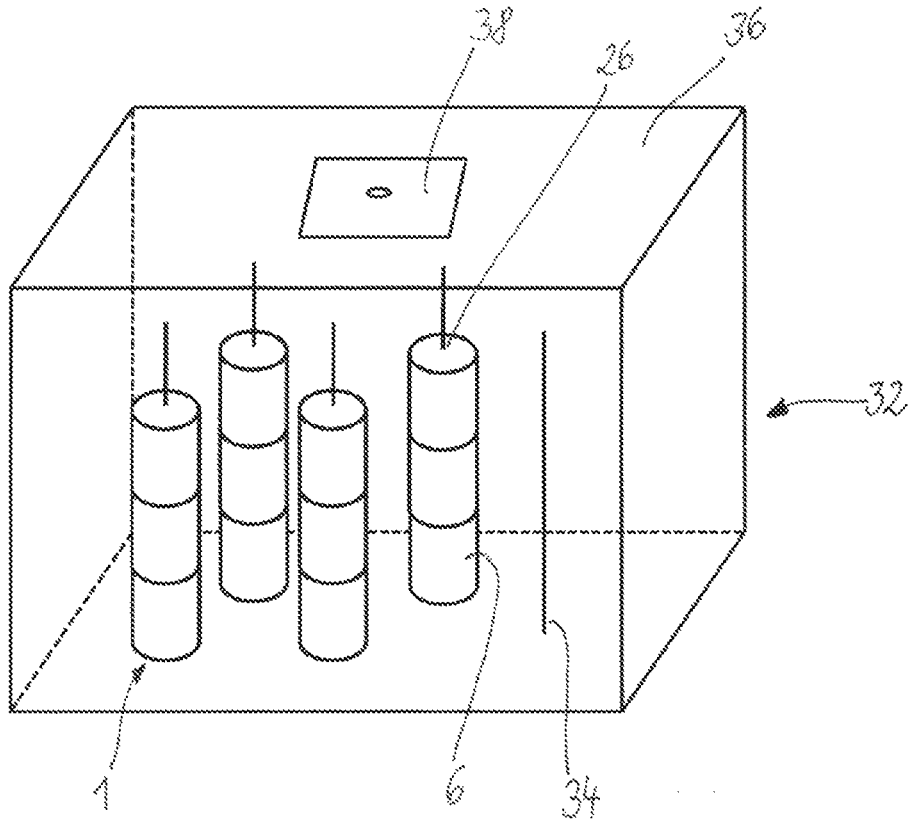
FIG. 2 is a schematic depiction of a coating system.

According to the disclosure the blind bore base 14 includes a through opening 26 which is a drilled opening. The drilling burrs arising during drilling of the blind hole can thereby on the one hand be easily removed so that abraded metal particles or other contaminants will not be carried to the to-be-lubricated points. On the other hand, as FIG. 2 shows, the suggested pin 1 can be attached to a stacking element (34, see FIG. 2), for example to a bar, via the blind bore opening 12 and the through opening 26, so that it is possible to stack a plurality of pins 1 one-atop-the other, wherein they each contact one another via their end walls 2, 4. Additionally or alternatively it is of course also possible to string the pins 1 together. This offers the advantage that a plurality of pins 1 stacked one-atop-the-other can simultaneously be subjected to a hardening- and/or edge-layer- and or another coating-method so that the outer wall 6 can be coated on an outer side 28 in order to increase its wear resistance with respect to mechanical stresses. The manufacturing of the pins 1 can thus be simplified and costs reduced.

As FIG. 1 shows, the through opening 26 is smaller than the blind bore opening 12. It is thereby possible to use only a small closure element 30 for sealing and closing the through opening 26. In order to close the through opening 26 in a simpler manner, the closure element 30 is preferably formed from a softer material than the pin 1. The material of the closure element 30 can be, for example, copper. The closure element 30 is thereby introducible into the through opening 26, in particular using press-fit. The dimensioning of the through opening 26 here is smaller than the dimensioning of the closure element 30 so that the through opening 26 is closable in a simple manner by press-fit and the pin 1 seals against a leaking of a lubricant introduced into the interior 10. Of course instead of the press fit other known connection types, detachable or permanent, from the prior art can be used.

FIG. 1 furthermore shows that the closure element 30 is spherical. A more favorable flow profile of the lubricant to be brought into or out of the pin 1 thereby results. Furthermore, a spherical closure element 30 is introducible into the through opening 26 in a simple manner using the above-described press-fit. Alternatively instead of the spherical shape the closure element can also have an ellipsoidal or also another shape, since the closure element 30 can be any closure element known from the prior art.

FIG. 2 shows a schematic depiction of a coating system 32 including a stacking device 34. Coating systems 32 are generally known from the prior art and can comprise a housing 36 that forms a coating chamber. A coating device 38 for coating the elements introduced into the chamber can furthermore be provided on or in the housing 36. Furthermore FIG. 2 shows a preferred shape of a stacking device 34 for the to-be-coated pin 1. The stacking device 34 can be, for example, a plurality of bars or rods that make possible a stacking together and/or a stringing together of the pins 1. Here the bars prevent the pins 1 from tipping over. Here the pins 1 are put on the bars via the blind bore opening and via the through opening 26, wherein the pins 1 contact one another on their end walls. The outer wall 6 of a plurality of pins 1 can thereby be simultaneously treated in a simple manner using a hardening- and/or edge-layer-method. Alternatively the pins can also be strung together in a spaced apart manner on the stacking device 34, for example, via spacer elements.

Generally with the help of the disclosed through opening, a pin can be provided that can be stacked together and/or strung together with at least one further pin in order to subject them to a hardening- and/or edge-layer- and/or coating method. Furthermore, using the proposed design of the pin, a contamination of the to-be-lubricated points, for example due to particles that can become detached from drilling burrs formed during drilling of the blind hole, can be avoided.

Representative, non-limiting examples of the present invention were described above in detail with reference to the attached drawings. This detailed description is merely intended to teach a person of skill in the art further details for practicing preferred aspects of the present teachings and is not intended to limit the scope of the invention. Furthermore, each of the additional features and teachings disclosed above may be utilized separately or in conjunction with other features and teachings to provide improved pins for valve control elements.

Moreover, combinations of features and steps disclosed in the above detailed description may not be necessary to practice the invention in the broadest sense, and are instead taught merely to particularly describe representative examples of the invention. Furthermore, various features of the above-described representative examples, as well as the various independent and dependent claims below, may be combined in ways that are not specifically and explicitly enumerated in order to provide additional useful embodiments of the present teachings.

All features disclosed in the description and/or the claims are intended to be disclosed separately and independently from each other for the purpose of original written disclosure, as well as for the purpose of restricting the claimed subject matter, independent of the compositions of the features in the embodiments and/or the claims. In addition, all value ranges or indications of groups of entities are intended to disclose every possible intermediate value or intermediate entity for the purpose of original written disclosure, as well as for the purpose of restricting the claimed subject matter.

REFERENCE NUMBER LIST

1 Cylindrical pin
2, 4 End wall
6 Outer wall
8 Blind bore
10 Interior
12 Blind bore opening
14 Blind bore base
16 Closure element
18 Securing element
20 External environment
22, 24 Opening
26 Through opening
28 Outer side
30 Closure element
32 Coating system
34 Housing
36 Housing
38 Coating device

What is claimed is:

1. A cylindrical pin of a valve control lever comprising an outer side wall, a first end wall and a second end wall and including a blind bore that extends from a blind bore opening in the first end wall to an inner surface of the second end wall, the inner surface forming a blind bore base, wherein the blind bore base includes at least one through opening, wherein at least one closure element is mounted in the at least one through opening, and wherein the at least one closure element is made from copper.

2. The cylindrical pin according to claim 1, wherein the at least one through opening has a smaller diameter than a diameter of the blind bore opening.

3. The cylindrical pin according to claim 1, wherein the at least one closure element is formed from a material that is softer than a material of the cylindrical pin.

4. The cylindrical pin according to claim 1, wherein the outer side wall is hardened and/or coated.

5. The cylindrical pin according to claim 1, wherein the outer side wall includes at least two through bores configured to allow a lubricant to enter and exit an interior of the pin.

6. A cylindrical pin of a valve control lever comprising an outer side wall, a first end wall and a second end wall and including a blind bore that extends from a blind bore opening in the first end wall to an inner surface of the second end wall, the inner surface forming a blind bore base, wherein the blind bore base includes at least one through opening;

wherein the at least one through opening has a smaller diameter than a diameter of the blind bore opening, including at least one copper closure element mounted in the at least one through opening, wherein the outer side wall is hardened and/or coated, and wherein the outer side wall includes at least two through bores configured to allow a lubricant to enter and exit an interior of the pin.

7. A cylindrical pin of a valve control lever comprising:

an outer side wall, a first end wall;

a second end wall;

a bore having a first diameter extending into the cylindrical pin from the first end wall and having a bore bottom between the first end wall and the second end wall;

a through opening in the bore bottom, the through opening having a second diameter less than the first diameter; and a closure element mounted in in the through opening, wherein the closure element is made from copper.

8. The cylindrical pin according to claim 7, wherein the closure element is formed from a material that is softer than a material of the cylindrical pin.

9. The cylindrical pin according to claim 7, wherein the outer side wall is hardened or coated.

10. The cylindrical pin according to claim 7, wherein the outer side wall includes at least two through bores configured to allow a lubricant to enter and exit an interior of the pin.

* * * * *